US009439518B2

(12) United States Patent
Oakes

(10) Patent No.: US 9,439,518 B2
(45) Date of Patent: Sep. 13, 2016

(54) CUTLERY DISPENSER

(75) Inventor: Shawn A. Oakes, Ripon, WI (US)

(73) Assignee: DIXIE CONSUMER PRODUCTS LLC, Atlanta, GA (US)

( * ) Notice: Subject to any disclaimer, the term of this patent is extended or adjusted under 35 U.S.C. 154(b) by 0 days.

(21) Appl. No.: 13/213,632

(22) Filed: Aug. 19, 2011

(65) Prior Publication Data

US 2013/0043272 A1 Feb. 21, 2013

(51) Int. Cl.
*A47F 1/12* (2006.01)
*A47F 1/10* (2006.01)

(52) U.S. Cl.
CPC ..... *A47F 1/125* (2013.01); *A47F 2001/103* (2013.01)

(58) Field of Classification Search
USPC ..... 221/191, 193, 208, 251, 255, 279
See application file for complete search history.

(56) References Cited

U.S. PATENT DOCUMENTS

| | | | |
|---|---|---|---|
| 46,832 | A | 3/1865 | Thorne |
| 592,105 | A | 10/1897 | Barnes |
| D32,913 | S | 7/1900 | Graf |
| 703,718 | A | 7/1902 | Cammann |
| 716,058 | A | 12/1902 | Lang et al. |
| 925,485 | A | 2/1909 | Lefler |
| 999,837 | A | 8/1911 | Morris et al. |
| 1,053,387 | A | 2/1913 | Hawley |
| 1,146,447 | A | 7/1915 | Prommel |
| 1,182,793 | A | 5/1916 | Richardson |
| 1,259,927 | A | 3/1918 | Swift |
| 1,261,835 | A | 4/1918 | Martin |
| 1,353,109 | A | 9/1920 | Carr |
| 1,355,583 | A | 10/1920 | Zeidler et al. |
| 1,482,071 | A | 1/1924 | Duff et al. |
| 1,497,585 | A | 6/1924 | Poole |
| 1,504,098 | A | 8/1924 | Cathey |
| 1,546,077 | A | 7/1925 | Hunter et al. |
| 1,547,151 | A | 7/1925 | Watling |
| 1,560,938 | A | 11/1925 | Lund |
| 1,577,302 | A | 3/1926 | Schultz |
| 1,610,001 | A | 12/1926 | Foster |
| 1,635,386 | A | 7/1927 | Pierson |
| 1,675,510 | A | 7/1928 | Nolan |
| 1,767,634 | A | 6/1930 | Weiss |
| 1,821,377 | A | 9/1931 | Cusick |
| 1,886,378 | A | 11/1932 | Dearsley |

(Continued)

FOREIGN PATENT DOCUMENTS

| | | | |
|---|---|---|---|
| CA | 2545745 | A1 | 11/2006 |
| CN | 2865478 | Y | 2/2007 |

(Continued)

OTHER PUBLICATIONS

Peel Adhesion for Single Coated Pressure-Sensitive Tapes 180 Angle, Aug. 1989, pp. 21-22.

(Continued)

*Primary Examiner* — Gene Crawford
*Assistant Examiner* — Kelvin L Randall, Jr.

(57) ABSTRACT

A cutlery dispenser comprising a front cover, a housing, and a pushing assembly. The front cover further includes an opening and at least stop. The at least one stop is configured to cause a utensil, such as a knife, fork, spork, or spoon, to fan through the opening for retrieval by a user. The pushing assembly urges the utensils forward in the dispenser toward the stop and toward the opening.

31 Claims, 10 Drawing Sheets

(56) References Cited

U.S. PATENT DOCUMENTS 1,936,057 A 11/1933 Hodge
2,052,505 A 8/1936 Vetrosky
2,053,828 A 9/1936 Harper
2,078,984 A 5/1937 Williamson
2,089,378 A 8/1937 Jenkin
2,110,189 A 3/1938 Zeidler, Sr.
2,141,684 A 12/1938 Diemer
2,149,098 A 2/1939 Phinney
2,149,099 A 2/1939 Phinney et al.
2,160,374 A 5/1939 Veillette
2,184,029 A 12/1939 Wicklund
2,188,573 A 1/1940 Longo
D119,760 S 4/1940 Kopp
2,207,528 A 7/1940 Witt
2,223,347 A 12/1940 Axthelm
2,239,196 A 4/1941 Lunvik
2,246,852 A 6/1941 Kale
2,260,596 A 10/1941 Young
2,268,596 A 1/1942 Jerum
2,268,873 A 1/1942 Hopkins et al.
2,328,486 A 8/1943 Painter
2,340,561 A 2/1944 Renfro
2,421,782 A 6/1947 Gibbs et al.
2,427,321 A 9/1947 Casey et al.
2,431,121 A 11/1947 Hunter
2,433,736 A 12/1947 Carew
2,445,026 A 7/1948 Frank
2,472,051 A 5/1949 Testi
2,497,718 A 2/1950 Earley et al.
2,503,741 A * 4/1950 Johnson ..... 221/303
2,526,136 A 10/1950 Holzknecht
2,571,668 A 10/1951 Booth et al.
2,577,344 A 12/1951 Masure
2,624,093 A 1/1953 Hatch et al.
2,635,025 A 4/1953 Ziska
2,646,874 A 7/1953 Testi
2,651,093 A 9/1953 Lynch
2,671,555 A 3/1954 Shnitzler
2,692,691 A 10/1954 Harriss et al.
2,695,125 A 11/1954 Bowen
2,752,678 A 7/1956 Welch
2,800,013 A 7/1957 George
2,806,634 A 9/1957 Baumgartner
2,843,909 A 7/1958 Eilertsen
2,845,679 A 8/1958 Baruch
2,857,645 A 10/1958 Vogelsang
2,868,344 A 1/1959 Shields
2,870,505 A 1/1959 Hawie
2,877,490 A 3/1959 Greninger
2,877,926 A 3/1959 Abbe
2,880,907 A 4/1959 Mainers
2,889,076 A 6/1959 Van Schie
2,907,512 A 10/1959 Leone
2,911,127 A 11/1959 Driss et al.
2,924,357 A 2/1960 Kingsley et al.
2,946,431 A 7/1960 Nissen
2,946,481 A 7/1960 Carew
2,953,170 A 9/1960 Bush
2,954,948 A 10/1960 Johnson
2,965,262 A 12/1960 Du Bois
3,037,257 A 6/1962 Girodet
3,052,006 A 9/1962 Jonas
3,083,879 A 4/1963 Coleman
3,095,114 A 6/1963 Tobias
3,100,842 A 8/1963 Tellefsen
3,114,475 A 12/1963 Etes
3,116,152 A 12/1963 Smith
3,132,765 A 5/1964 Florendo
3,146,908 A 9/1964 Perri et al.
3,163,327 A 12/1964 Maxwell
3,180,489 A 4/1965 McGinn
3,182,345 A 5/1965 Smith
3,191,802 A 6/1965 Lasting
3,263,860 A 8/1966 Haas
3,279,652 A 10/1966 Willvonseder
3,300,087 A 1/1967 Kuypers
3,310,271 A 3/1967 King
3,313,452 A 4/1967 Katz
3,334,784 A 8/1967 Morrison
3,338,471 A 8/1967 De Good
3,371,821 A 3/1968 Abood, Jr. et al.
3,383,018 A 5/1968 Grimsley
3,400,435 A 9/1968 Akesson-Rydin
3,402,441 A 9/1968 Woskin
3,407,927 A 10/1968 Jones
3,408,708 A 11/1968 Hawie
3,426,941 A 2/1969 Hovekamp
3,435,491 A 4/1969 Shears
3,472,421 A 10/1969 Bailer
3,499,538 A 3/1970 Sherard
3,558,006 A 1/1971 Redmond et al.
3,587,922 A 6/1971 Oriti
3,593,908 A 7/1971 Desmond et al.
3,654,396 A 4/1972 Biezeveld
3,680,736 A 8/1972 Viessmann
3,710,535 A 1/1973 Walter
3,741,410 A 6/1973 Henschke et al.
3,747,803 A 7/1973 Zoepf et al.
3,786,959 A 1/1974 Greb et al.
3,851,762 A 12/1974 Liblick
3,854,625 A 12/1974 Kuebler
3,861,563 A * 1/1975 Lisbin et al. ..... 221/279
3,862,702 A 1/1975 Johnson
3,897,886 A 8/1975 Franklin
3,932,978 A 1/1976 Kinney
3,944,128 A 3/1976 Hogan et al.
3,972,118 A 8/1976 Richard
3,987,901 A 10/1976 Dullinger
3,998,238 A 12/1976 Nigro
4,005,801 A 2/1977 Musser et al.
4,043,203 A 8/1977 Montesi
4,048,915 A 9/1977 Martin
4,091,915 A 5/1978 Claasen
4,120,662 A 10/1978 Fosslien
4,134,519 A * 1/1979 Barnett et al. ..... 221/46
4,146,123 A 3/1979 Cottrell
4,271,999 A 6/1981 Stravitz
4,288,003 A 9/1981 Fries
4,308,974 A 1/1982 Jones
4,317,284 A 3/1982 Prindle
4,382,514 A 5/1983 Williams et al.
4,489,854 A 12/1984 Wenkman et al.
4,524,512 A 6/1985 Formo et al.
4,570,536 A 2/1986 Dodd
4,571,773 A 2/1986 Yuda
4,574,423 A 3/1986 Ito et al.
D284,442 S 7/1986 Chan
4,601,386 A 7/1986 Antonello
4,610,087 A 9/1986 Mickelson et al.
4,614,004 A 9/1986 Oshida
4,624,616 A 11/1986 Freese et al.
4,638,921 A 1/1987 Sigl et al.
4,662,536 A 5/1987 Powers
4,666,037 A 5/1987 Weissman et al.
4,666,060 A 5/1987 Bouldin
4,691,811 A 9/1987 Arakawa et al.
4,697,673 A 10/1987 Omata
4,707,251 A 11/1987 Jenkins
4,715,514 A 12/1987 Vidondo
4,789,064 A 12/1988 Segal
4,793,539 A 12/1988 Haenni et al.
4,835,864 A 6/1989 Tang
4,863,033 A 9/1989 Buj
4,884,718 A 12/1989 Leahy
D305,709 S 1/1990 Blignaut
4,896,792 A 1/1990 Marchand
4,915,578 A 4/1990 Becker
4,921,106 A 5/1990 Spatafora et al.
4,950,120 A 8/1990 Barnes
4,961,684 A 10/1990 Provan et al.
4,963,072 A 10/1990 Miley et al.
RE33,447 E 11/1990 Rosman
4,973,037 A 11/1990 Holbrook
4,986,442 A 1/1991 Hinterreiter

(56) References Cited

U.S. PATENT DOCUMENTS 4,989,730 A 2/1991 Lemoine et al.
4,995,154 A 2/1991 Bamber
5,012,927 A 5/1991 Borst et al.
D318,600 S 7/1991 Lillelund et al.
5,054,640 A 10/1991 Tucker et al.
5,054,649 A 10/1991 Lemaire et al.
5,064,093 A 11/1991 Davis et al.
5,080,257 A 1/1992 Carnisio
5,127,546 A 7/1992 Chen
5,131,586 A 7/1992 Capy
5,156,266 A 10/1992 Sykora et al.
5,161,268 A 11/1992 Harrow
5,176,494 A 1/1993 Nigrelli et al.
5,191,997 A 3/1993 Squitieri
5,199,756 A 4/1993 Bartlett et al.
5,211,267 A 5/1993 Clark
5,249,705 A 10/1993 Gates
5,263,596 A 11/1993 Williams
D342,648 S 12/1993 Cautereels et al.
5,269,397 A 12/1993 Kawamoto et al.
5,305,875 A 4/1994 Meyer et al.
5,325,992 A 7/1994 Koller et al.
5,327,650 A 7/1994 Rojas
D351,085 S 10/1994 Schmidt
5,353,935 A 10/1994 Yeager et al.
5,364,016 A 11/1994 Capy et al.
5,413,317 A 5/1995 Spoerre
D362,160 S 9/1995 Brabeck et al.
5,449,054 A 9/1995 Wiese et al.
5,460,252 A 10/1995 Kosugi et al.
5,469,688 A 11/1995 Dunbar et al.
5,479,708 A 1/1996 Thomas
5,497,863 A 3/1996 Schmidt et al.
5,509,522 A 4/1996 Laidlaw
5,518,149 A 5/1996 Lotspeich et al.
5,542,508 A 8/1996 Van Erden et al.
5,564,594 A 10/1996 Monfredo
5,579,910 A 12/1996 Bennett
5,586,685 A 12/1996 Dorner et al.
5,590,472 A 1/1997 Yaakov
5,605,208 A 2/1997 Friedrichsen et al.
5,660,252 A 8/1997 Lafon
5,762,211 A 6/1998 Ensign
5,845,403 A 12/1998 Nivin
5,853,092 A 12/1998 Goodman et al.
5,904,250 A 5/1999 De Schutter
5,921,408 A 7/1999 Groenewold et al.
5,933,918 A 8/1999 Wallays
5,950,842 A 9/1999 Baur
5,961,021 A 10/1999 Koike et al.
D420,887 S 2/2000 Chen
6,023,908 A 2/2000 Vetsch
6,023,913 A 2/2000 Gray et al.
D422,431 S 4/2000 Goins
6,047,830 A 4/2000 Chang
6,062,424 A 5/2000 Simile-Gravina et al.
6,073,795 A 6/2000 Longstreth
6,076,670 A 6/2000 Yeranossian
6,085,916 A 7/2000 Kovacevic et al.
6,098,379 A 8/2000 Spatafora et al.
6,115,921 A 9/2000 Garneau
6,134,790 A 10/2000 Watson
6,202,891 B1 3/2001 Mark
6,226,845 B1 5/2001 Fink
6,250,495 B1 6/2001 Bando
6,250,498 B1 * 6/2001 Lovejoy ..... 221/185
6,289,889 B1 9/2001 Bell et al.
6,298,960 B1 10/2001 Derr
6,378,729 B1 4/2002 Kodama
D458,070 S 6/2002 Bennett et al.
6,399,079 B1 6/2002 Mehta et al.
6,412,398 B1 7/2002 Norcross et al.
6,415,465 B1 7/2002 Harrow
6,575,313 B1 6/2003 Chen
6,626,633 B2 9/2003 Jendzurski et al.
6,651,841 B2 11/2003 Tsuchida
6,749,074 B1 6/2004 Hileman et al.
D492,549 S 7/2004 Welch
D493,337 S 7/2004 Welch
6,763,972 B2 7/2004 Graupner
6,786,357 B2 9/2004 Renard
6,786,359 B1 9/2004 Schroeder
6,832,694 B2 12/2004 Goeking et al.
6,832,698 B1 12/2004 Dybul
6,837,028 B1 1/2005 Miano et al.
6,840,353 B2 1/2005 Arisaka
6,840,420 B1 1/2005 Hudson
6,863,173 B2 3/2005 Bennett
6,880,211 B2 4/2005 Jackson et al.
6,895,672 B2 5/2005 Conforti
6,945,427 B2 9/2005 Hieb
6,972,033 B2 12/2005 McNicholas
6,976,348 B1 12/2005 Miano et al.
7,013,568 B2 3/2006 Schmidt
7,076,932 B2 7/2006 Rubin
7,090,455 B2 8/2006 Lamb
7,111,369 B2 9/2006 Ho
D533,034 S 12/2006 Wasserman
7,156,220 B2 1/2007 Olson et al.
D536,222 S 2/2007 Heiberg et al.
7,204,406 B2 4/2007 Bone et al.
7,210,279 B1 5/2007 Ahmed et al.
7,237,700 B2 7/2007 Bulovic
7,249,793 B1 7/2007 Jabr et al.
7,258,233 B2 8/2007 Lee et al.
7,322,172 B2 1/2008 Hoffman et al.
D564,819 S 3/2008 Fosburg et al.
7,412,808 B2 8/2008 Lavi
7,424,957 B1 9/2008 Luberto
7,434,692 B2 10/2008 Ginsberg et al.
D591,104 S 4/2009 Oakes
7,513,089 B2 4/2009 Rubin
7,516,831 B2 4/2009 Chang
7,520,247 B2 4/2009 Rutledge
7,669,256 B2 3/2010 Harrow
7,716,842 B2 5/2010 Sumner-Trivisani et al.
7,731,899 B2 6/2010 Talmer et al.
7,819,234 B2 10/2010 Herzog
7,856,722 B2 12/2010 Lago-Arenas
D631,337 S 1/2011 Prevost
8,070,013 B2 12/2011 Reinsel et al.
8,083,058 B2 12/2011 Marcinkowski et al.
8,083,097 B2 12/2011 Kaufman et al.
8,152,004 B2 4/2012 Smith et al.
8,272,533 B1 9/2012 D'Amelia
8,296,957 B2 10/2012 Muehlemann
8,297,473 B2 10/2012 Smith
8,302,269 B2 11/2012 Pitman
8,360,273 B2 1/2013 Reinsel et al.
8,480,954 B2 7/2013 Talmer et al.
8,776,379 B2 7/2014 Walters et al.
8,839,522 B2 9/2014 Walters et al.
8,844,798 B2 9/2014 Linkel
2001/0007308 A1 7/2001 Glassman et al.
2001/0025856 A1 10/2001 Grosriez et al.
2002/0112445 A1 8/2002 Scaduto
2003/0015824 A1 1/2003 Forbes et al.
2003/0098344 A1 5/2003 Blake et al.
2003/0146061 A1 8/2003 Tournier
2004/0045398 A1 3/2004 Hayashi
2004/0045860 A1 3/2004 Edgerly et al.
2004/0089670 A1 5/2004 Goeking et al.
2004/0237311 A1 12/2004 Brown et al.
2005/0035136 A1 2/2005 Dathe et al.
2005/0082307 A1 4/2005 Tucker
2005/0116482 A1 6/2005 Harris et al.
2005/0155186 A1 7/2005 McGuyer et al.
2005/0155229 A1 7/2005 Lee
2005/0211722 A1 * 9/2005 Runnels ..... 221/259
2005/0252057 A1 11/2005 Lavi
2006/0000190 A1 1/2006 Behnke et al.
2006/0042986 A1 3/2006 Simkowski et al.
2006/0053638 A1 3/2006 Sumner-Trivisani et al.
2006/0218795 A1 10/2006 Cruz et al.

(56) References Cited

U.S. PATENT DOCUMENTS

| | | | | |
|---|---|---|---|---|
| 2006/0249531 | A1 | 11/2006 | Litchfield et al. | |
| 2007/0035943 | A1 | 2/2007 | Wang | |
| 2007/0108141 | A1 | 5/2007 | Smith et al. | |
| 2007/0131705 | A1 | 6/2007 | Behravesh et al. | |
| 2007/0193968 | A1 | 8/2007 | Smith et al. | |
| 2007/0214650 | A1 | 9/2007 | Tomazini | |
| 2007/0250391 | A1 | 10/2007 | Prade et al. | |
| 2008/0118609 | A1 | 5/2008 | Harlfinger et al. | |
| 2008/0121650 | A1 | 5/2008 | Smith | |
| 2008/0128445 | A1 | 6/2008 | Huang et al. | |
| 2009/0194557 | A1* | 8/2009 | Van Deursen | 221/232 |
| 2010/0084418 | A1 | 4/2010 | Reinsel et al. | |
| 2010/0147869 | A1 | 6/2010 | Iliffe et al. | |
| 2010/0170915 | A1 | 7/2010 | Reinsel et al. | |
| 2011/0180562 | A1 | 7/2011 | Reinsel et al. | |
| 2011/0226797 | A1 | 9/2011 | Reinsel et al. | |
| 2011/0296693 | A1 | 12/2011 | Oakes | |
| 2012/0036724 | A1 | 2/2012 | Walters | |
| 2012/0047744 | A1 | 3/2012 | Walters | |
| 2012/0080444 | A1 | 4/2012 | Smith et al. | |
| 2012/0110746 | A1 | 5/2012 | Serrano et al. | |
| 2012/0145734 | A1 | 6/2012 | Walters | |
| 2012/0145735 | A1 | 6/2012 | Erickson et al. | |
| 2012/0145736 | A1 | 6/2012 | Walters et al. | |
| 2013/0032609 | A1 | 2/2013 | Righetti et al. | |
| 2013/0126548 | A1 | 5/2013 | Pourian et al. | |
| 2013/0134211 | A1 | 5/2013 | Linkel | |
| 2013/0152406 | A1 | 6/2013 | McFarland | |
| 2013/0193157 | A1 | 8/2013 | Jongen et al. | |
| 2014/0069930 | A1 | 3/2014 | Oakes | |
| 2014/0117036 | A1 | 5/2014 | Smith et al. | |
| 2014/0299656 | A1 | 10/2014 | Wintermute | |
| 2015/0028045 | A1 | 1/2015 | Oakes et al. | |
| 2015/0028046 | A1 | 1/2015 | Oakes et al. | |
| 2015/0041363 | A1 | 2/2015 | Freeman et al. | |
| 2015/0041484 | A1 | 2/2015 | Oakes | |
| 2015/0048108 | A1 | 2/2015 | Borke | |
| 2015/0289679 | A1 | 10/2015 | Oakes | |

FOREIGN PATENT DOCUMENTS

| | | | |
|---|---|---|---|
| CN | 101495015A | A | 7/2009 |
| CN | 103919421 | A | 7/2014 |
| DE | 7033238 | U1 | 11/1970 |
| DE | 7127677 | U | 11/1971 |
| DE | 3151268 | | 7/1983 |
| DE | 4139938 | | 6/1993 |
| DE | 9316566 UI | | 1/1994 |
| DE | 19906369 | | 2/2000 |
| DE | 202005013647 | U1 | 7/2006 |
| EP | 0257109 | A1 | 8/1986 |
| EP | 0286538 | A1 | 10/1988 |
| EP | 0856272 | A2 | 1/1999 |
| EP | 1022107 | A1 | 7/2000 |
| EP | 1217923 | B1 | 9/2003 |
| EP | 1358827 | A3 | 11/2003 |
| EP | 1213985 | B1 | 6/2004 |
| EP | 1514497 | A1 | 3/2005 |
| EP | 1719438 | A1 | 11/2006 |
| EP | 1864596 | A2 | 12/2007 |
| FR | 2889507 | A1 | 2/2007 |
| JP | JH06121727A | A | 5/1994 |
| JP | 08011934 | A | 1/1996 |
| JP | 08-047440 | A | 2/1996 |
| JP | 3042582 | U | 10/1997 |
| JP | 2001354214 | A | 12/2001 |
| JP | 2004261336 | A | 9/2004 |
| JP | 2007319493 | A | 12/2007 |
| KR | 1991-0008085 | Y1 | 10/1991 |
| KR | 10-2009-0071515 | A | 7/2009 |
| KR | 100954569 | B1 | 4/2010 |
| TW | M287639 | U | 2/2006 |
| TW | M293720 | U | 7/2006 |
| WO | 01/05280 | A1 | 1/2001 |
| WO | 01/05281 | A1 | 1/2001 |
| WO | 01/68492 | A1 | 9/2001 |
| WO | 2004/028309 | A1 | 4/2004 |
| WO | 2007/049982 | A1 | 5/2007 |
| WO | 2007/012606 | A1 | 11/2007 |
| WO | 2008/058187 | A2 | 5/2008 |
| WO | 2009137367 | A2 | 11/2009 |

OTHER PUBLICATIONS

Tack Rolling Ball, Aug. 1989, pp. 29-30.
Holding Power of Pressure-Sensitive Tape, Aug. 1989, pp. 31-33.
European Patent Report 06009258.2, mailed Jul. 24, 2006, five pages, Munich, Germany.
International Search Report and Written Opinion for PCT/US07/83752, mailed Mar. 11, 2008, ten pages, European Patent Office, Munich, Germany.
Partial International Search Report for PCT/US2007/083922, mailed Jul. 8, 2008, two pages.
European Search Report for EP 08 014 387.8 mailed Nov. 11, 2008, two pages, European Patent Office, Munich, Germany.
International Search Report and Written Opinion for PCT/US2007/083922, mailed Nov. 17, 2008, 13 pages, European Patent Office, Rijswijk, Netherlands.
International Search Report and Written Opinion for PCT/US2009/059915, mailed Feb. 3, 2010, 13 pages, European Patent Office, Munich, Germany.
Office Actions for U.S. Appl. No. 11/556,808, filed Nov. 6, 2006.
Office Actions for U.S. Appl. No. 11/415,836, filed May 2, 2006.
Office Actions for U.S. Appl. No. 11/936,401, filed Nov. 7, 2007.
Office Action for U.S. Appl. No. 12/349,203, filed Jan. 6, 2009.
KIPO, International Searching Authority, "International Search Report and Written Opinion for PCT/US2014/047463", mailed Nov. 26, 2014, 22 pages, Korean Intellectual Property Office, South Korea.
KIPO, International Searching Authority, "International Search Report and Written Opinion for PCT/US2014/050166", mailed Nov. 20, 2014, 11 pages, Korean Intellectual Property Office, South Korea.
KIPO, International Searching Authority, "International Search Report and Written Opinion for PCT/US2014/050169", mailed Jan. 9, 2015, 11 pages, Korean Intellectual Property Office, South Korea.
KIPO, International Searching Authority, "International Search Report and Written Opinion for PCT/US2014/051632", mailed Dec. 3, 2014, 9 pages, Korean Intellectual Property Office, South Korea.
KIPO, International Searching Authority, "International Search Report and Written Opinion for PCT/US2014/051639", mailed Dec. 9, 2014, 9 pages, Korean Intellectual Property Office, South Korea.
PCT, International Search Report and Written Opinion for PCT/US2010/000051, mailed Aug. 16, 2010, 6 pages.
International Search Report and Written Opinion for PCT/US2011/044931 mailed Feb. 28, 2012.
International Search Report and Written Opinion for PCT/US2011/044934 mailed Mar. 6, 2012.
International Search Report and Written Opinion for PCT/US2011/058767 mailed Feb. 29, 2012.
International Search Report and Written Opinion for PCT/US2011/064057 mailed Feb. 29, 2012.
International Search Report and Written Opinion for PCT/US2011/058329 mailed Feb. 29, 2012.
Supplementary European Search Report dated Sep. 25, 2013 for Application No. 11793088.3.

* cited by examiner

CUTLERY DISPENSER

RELATED FIELDS

The invention relates to the field of cutlery utensil dispensers.

BACKGROUND

Eating facilities often provide cutlery utensils in dispensing bins, where all customers place their hands into the bins to retrieve a fork, spoon, knife, or spork. Open air bins are relatively unhygienic, however, and can spread hand-carried bacteria and the like to other utensils in the bin or to another customer.

To address concerns relating to dispensing of hygienic cutlery utensils, enclosed dispensers have been used where a plurality of cutlery utensils is placed in a utensil compartment and dispensed one at a time on command by operation of a dispensing lever, rotating belt, and/or other dispensing mechanism. The mechanics of these dispensers are overly complex, however, and, as a result, these dispensers are subject to malfunction. Additionally, these dispensers are typically quite large and cumbersome. They occupy a large amount of surface area in an already crowded eating facility.

SUMMARY

Disclosed are improved cutlery dispensers.

According to some versions, there is provided a cutlery dispenser comprising: (a) a housing comprising a pushing assembly comprising at least one biasing mechanism and a support member coupled to the at least one biasing mechanism, wherein the at least one biasing mechanism urges the support member toward a front of the dispenser and (b) a front cover coupled to the housing, the front cover comprising (i) a front surface comprising an opening, (ii) a rear surface, iii) at least one stop, wherein, the at least one stop is configured to interact with a portion of a utensil housed within the housing to cause the utensil to fan through the opening when a force is applied to the utensil by the support member.

Additional or alternate versions are also provided.

BRIEF DESCRIPTION OF THE DRAWINGS

A full and enabling disclosure directed to one of ordinary skill in the art is set forth more particularly in the remainder of the specification. The specification makes reference to the following appended figures, in which use of like reference numerals in different figures is intended to illustrate like or analogous components. Directional terms used herein such as "front," "right," "middle," "back," "left," "depth," "width," "height," "length," etc. are all relative terms in reference to the Figures and are not intended to be limiting.

DETAILED DESCRIPTION

Figure 1:
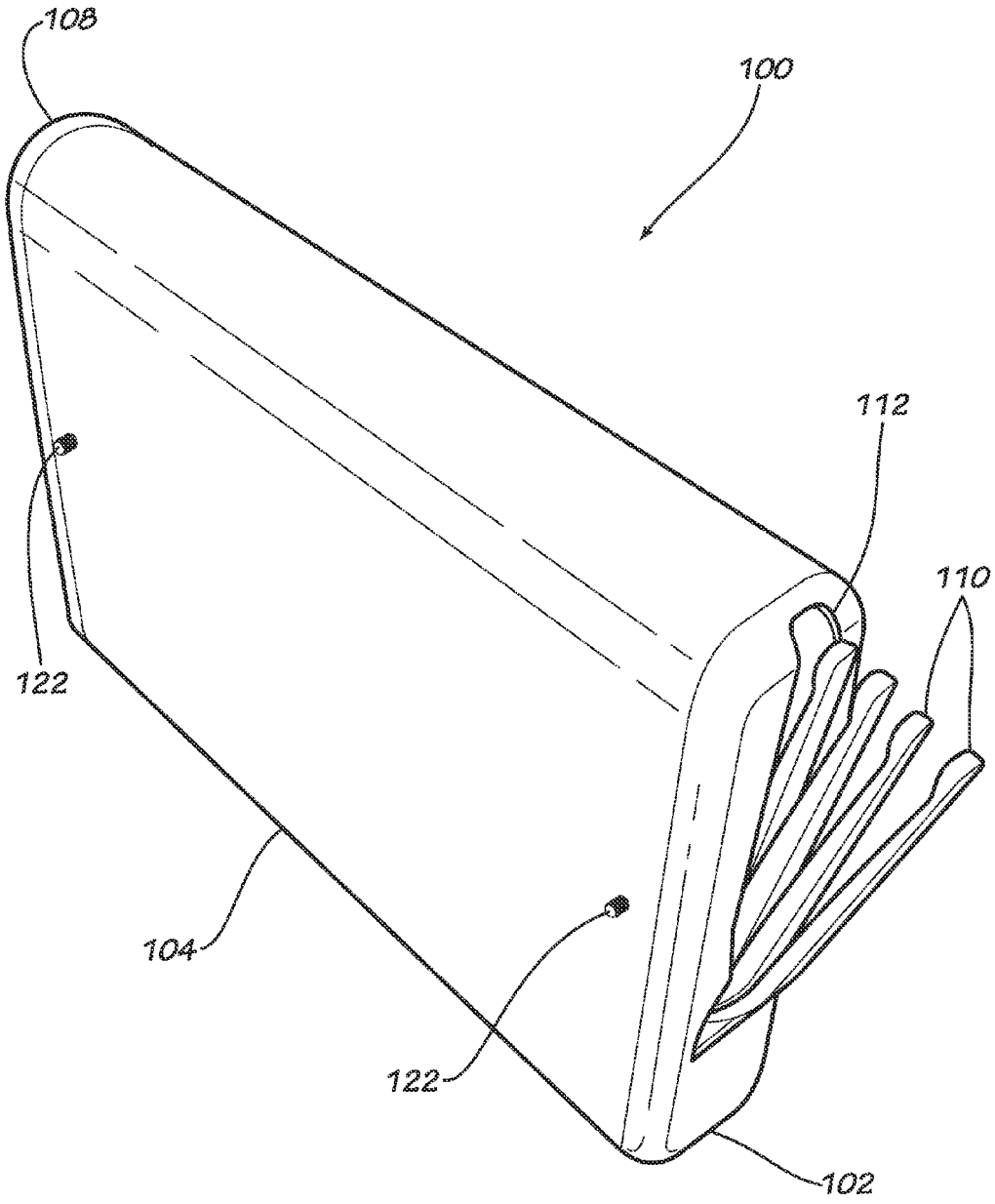
FIG. 1 is a front perspective view of a cutlery dispenser according to one embodiment, shown in the closed position.
Figure 2:
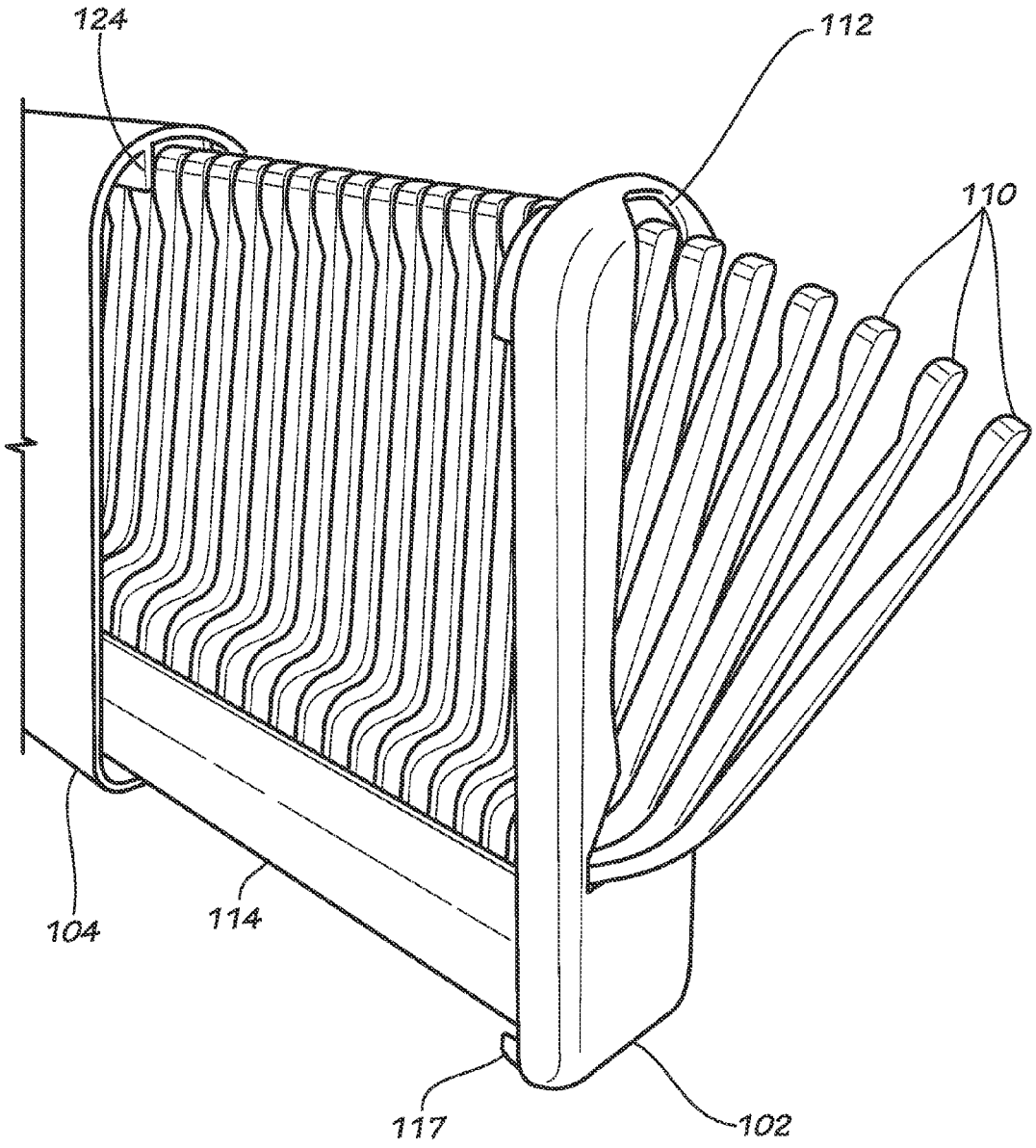
FIG. 2 is a front perspective view of the cutlery dispenser of FIG. 1, shown in the open position.

FIGS. 1-12 illustrate one embodiment of a cutlery dispenser 100. The cutlery dispenser 100 includes a front cover 102, a housing 104, and a pushing assembly 106 (all shown in FIG. 3). In some embodiments, the cutlery dispenser 100 may further include an end-cap 108 (shown in FIG. 3).

As explained in more detail below, the front cover 102 may be assembled with respect to the housing 104 to restrict access to a utensil 110 stored within cutlery dispenser 100. The front cover 102 may be constructed of a number of materials, including, but not limited to polypropylene, other plastics, aluminum, or any other suitable material. The shape of the front cover 102 may vary depending on the shape and configuration of the cutlery dispenser 100 and the housing 104. In some embodiments, a length L1 of the front cover 102 (FIG. 4) may be slightly greater than the corresponding dimension (such as the length) of the utensil 110 to be dispensed from the cutlery dispenser 100, and a width W of the front cover 102 may be slightly greater than the corresponding dimension (such as the width) of the utensil 110 to be dispensed from the cutlery dispenser 100. The profile of the front cover 102 may also generally correspond to the shape of the housing 104. Possible profile shapes of the front cover 102 include, but are not limited to, rectangles, triangles, squares, etc, and variants thereof. In the embodiment illustrated in FIGS. 1-12, for example, the profile of the front cover 102 is generally rectangular with curved corners.

In some embodiments, the front cover 102 may include a front surface 144 that includes an opening 112, a rear surface 146, and at least one stop 116 (see FIGS. 2 and 5-7). In some embodiments, the front cover 102 may include a trough 114. The opening 112 extends through the front cover 102 and along at least a portion of the length of the front cover 102. A length of the opening 112 may vary depending upon the utensil 110 to be housed and dispensed. For example, in some embodiments, such as the embodiment illustrated in FIGS. 1-12, the length L2 of the opening 112 (FIG. 4) may correspond to a dimension (such as the length) of the utensil 110. Additionally, in some embodiments, such as the embodiment illustrated in FIGS. 1-12, the shape of the opening 112 may correspond to the shape of at least a portion of the utensil 110 to be housed and dispensed from the cutlery dispenser 100, as illustrated in FIGS. 1-7. In the embodiment illustrated in FIGS. 1-12, for example, the shape of the opening 112 corresponds to the shape of the handle of a fork 110. In other embodiments, the shape of the opening 112 may correspond to the shape of another portion of the fork 110 such as the eating/utility end, or may correspond to the shape of another utensil 110.

If used, the trough 114, as illustrated in FIGS. 2-3 and 5-6, may extend from the rear surface 146 of the front cover 102.

In other embodiments, a gap may exist between the rear surface 146 and the trough 114. The trough 114 may be configured to hold a plurality of utensils 110. In some embodiments, such as the embodiment illustrated in FIGS. 1-12, the trough 114 is integrally formed with the front cover 102. In other embodiments, the trough 114 may be coupled to the front cover 102 and may be formed of the same or different materials than the front cover 102. For example, in some embodiments, the trough 114 may be constructed from a rigid material such as polypropylene, other plastics, aluminum, or any other suitable material, while the front cover 102 is formed of similar or other materials. The cross-sectional shape of the trough 114 may vary, but is generally basket-shaped in some embodiments. In some embodiments, the shape of the trough 114 may correspond to the shape of the utensil 110 to be dispensed from the cutlery dispenser 100. For example, in the embodiment illustrated in FIGS. 1-12, the shape of the trough 114 corresponds to the eating/utility end of the fork 110 as illustrated in FIGS. 2-3 and 5-6.

One having ordinary skill in the art will recognize that the cutlery dispenser 100 may be configured so that a trough 114 is not necessary. In those embodiments, housing 104 may be configured to hold the utensils 110 and to interact with the pushing assembly 106 explained in detail below. For example, the track 118 (described below) may help guide the utensils 110 as they move toward the opening 112.

The at least one stop 116 may be configured to interact with the utensil 110 to be dispensed and to cause at least a portion of the utensil 110 to fan through the opening 112 such that the utensil 110 is pivotally rotated about the at least one stop 116. In some embodiments, the fanning may also cause a separation between the utensils 110, as illustrated in FIG. 1, although such separation between utensils 110 is not necessary. For example, in the embodiment illustrated in FIGS. 1-12, the at least one stop 116 interacts with the utility/eating end of the fork 110 so as to fan the handle of the fork 110 through the opening 112. In this particular embodiment, the fanning also causes a separation between the forks 110 so that the handles of the fanned forks 110 do not contact one another. In other embodiments, the at least one stop 116 interacts with the handle of the utensil 110 and causes the utility end of the utensil 110 to fan through the opening 112. Essentially, the at least one stop 116 restricts the progression of a portion of the utensil 110 through the trough 114 and front cover 102 to cause another portion of the utensil 110 to fan through the opening 112.

The position and configuration of the at least one stop 116 (shown in FIGS. 5-7) may vary from that illustrated in the Figures. As one example, the positioning and configuration of the at least one stop 116 may vary (as described below) depending on the desired degree of fanning of the utensils 110. The position and configuration of the at least one stop 116 may also be varied to induce a desired amount of separation between utensils 110 and to vary the extent through which a utensil 110 extends through the opening 112. For example, the at least one stop 116 may be positioned adjacent the trough 114, adjacent the rear surface 146 of the front cover 102, or both. In some embodiments, the at least one stop 116 may be adjacent the housing 104.

Figure 5:
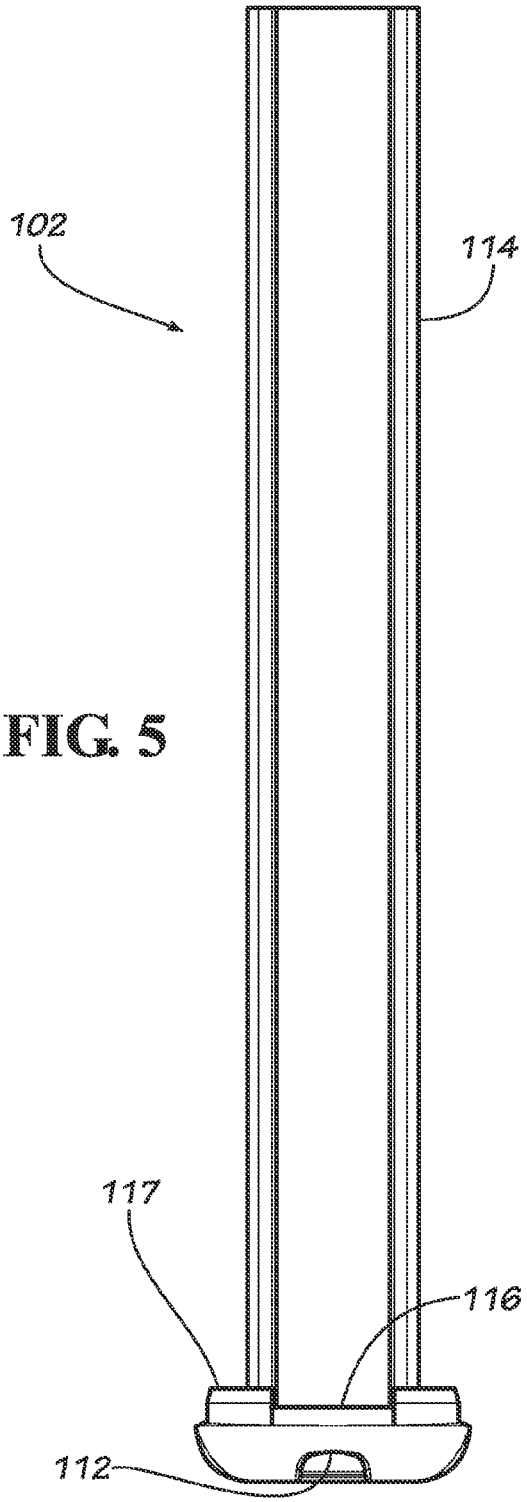
FIG. 5 is a top view of the front cover of the cutlery dispenser of FIG. 1.
Figure 6:
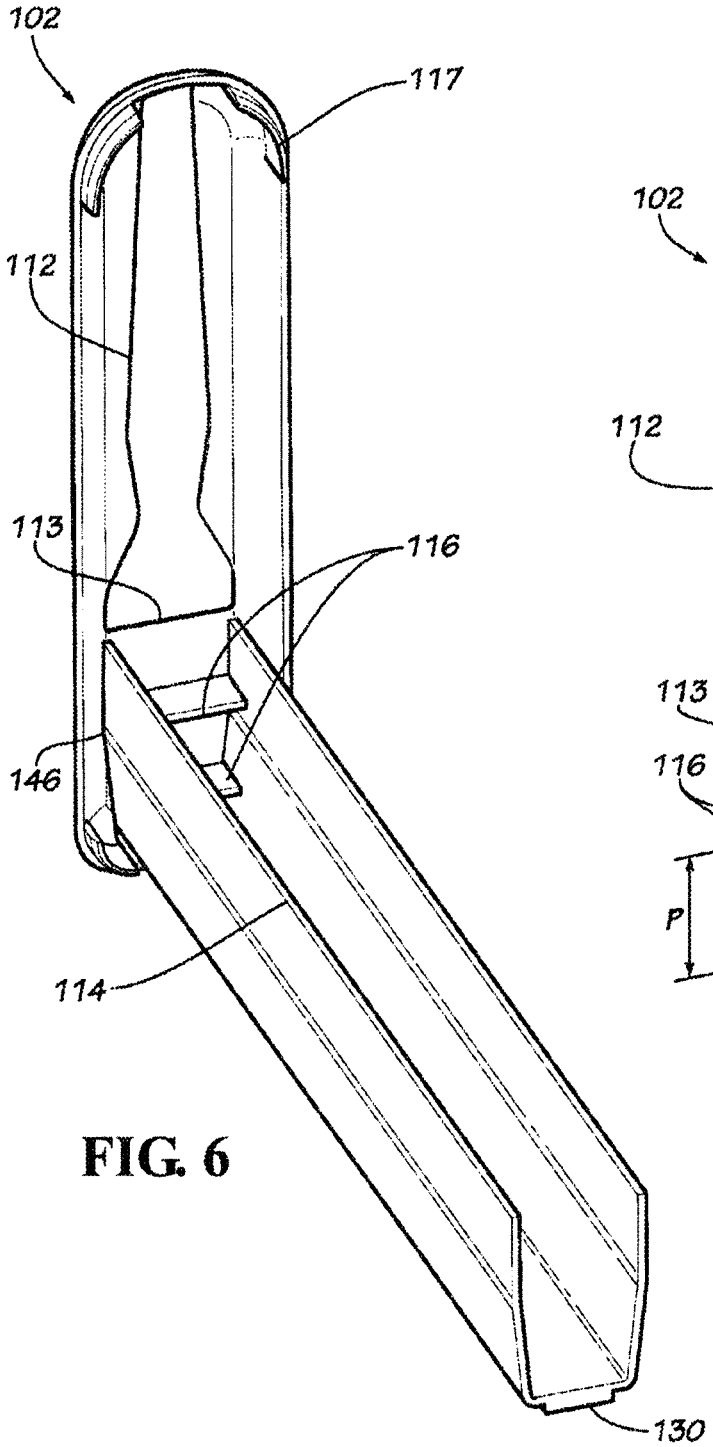
FIG. 6 is a rear perspective view of the front cover of the cutlery dispenser of FIG. 1.
Figure 7:
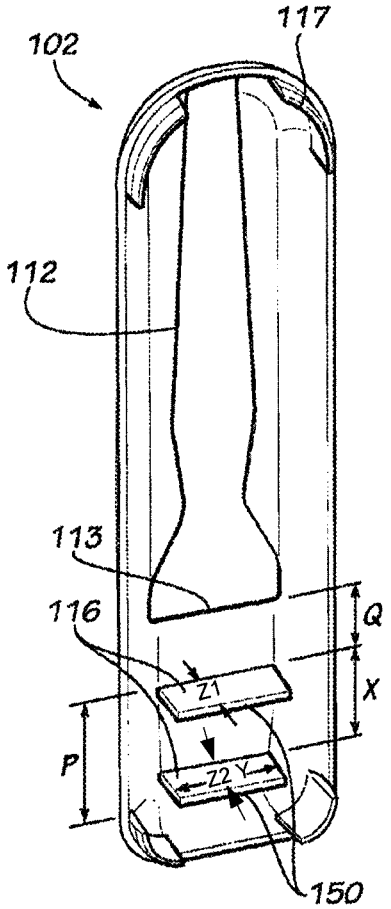
FIG. 7 is a rear perspective view of the front cover of the cutlery dispenser of FIG. 6, with the trough removed.
Figure 8:
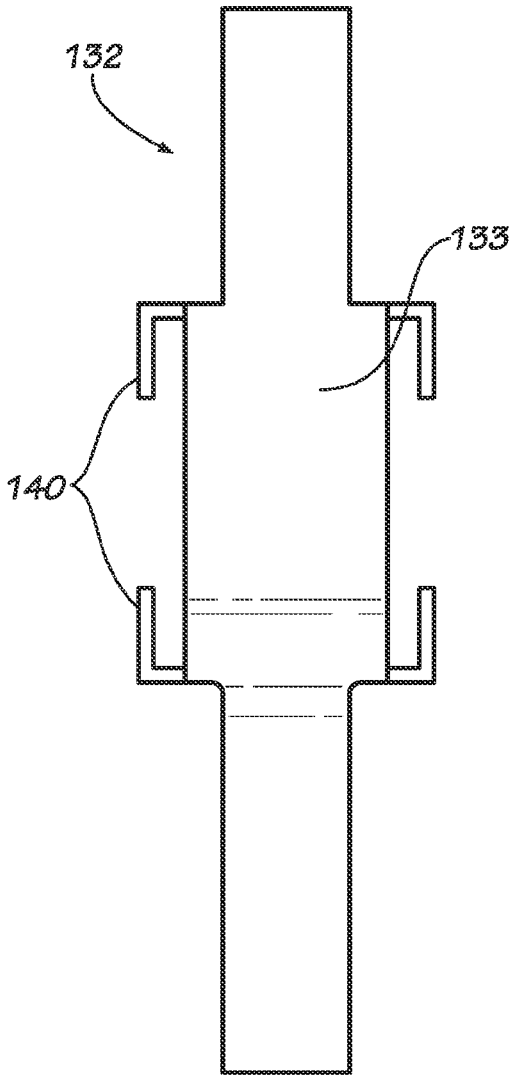
FIG. 8 is a front view of the support member of the cutlery dispenser of FIG. 1.

In the embodiment illustrated in FIGS. 1-12, the front cover 102 includes two stops 116. In this embodiment, the stops 116 are two generally horizontal plates (FIG. 7). The two stops 116 are separated from one another by a distance X and each have a width Y and a depth Z. The depth Z by which the at least one stop 116 projects from the rear surface 146 of the front cover 102 may be varied to influence the extent and the angle at which the utensils 110 fan through the opening 112. If it is desired that the utensils 110 fan through the opening 112 at a lesser angle or extent, the at least one stop 116 may project from the rear surface 146 by a distance less than Z. Conversely, if it is desired that the utensils 110 fan through the opening 112 at a greater angle or extent, the at least one stop 116 may project from the rear surface 146 by a distance greater than Z. Essentially, in some embodiments, the further down the trough 114 that the at least one stop 116 is projected or positioned, the greater the angle and extent the utensils 110 will be separated at one end. In some embodiments, the at least one stop 116 does not project generally laterally from the rear surface 146, but instead projects at any suitable angle from the rear surface 146. In other embodiments, the at least one stop 116 projects from the sidewalls or base of the trough 114 instead of the rear surface 146.

In alternate embodiments, the at least one stop 116 includes more than two stops 116, or includes only one stop 116. As only one example, instead of having two stops 116 in the form of plates, one stop 116 could have a length that spans the distance X. As examples of other variations, the distance X may be smaller or larger than illustrated, and the width Y and/or the depth Z of the stop 116 may be smaller or larger than illustrated. Moreover, the at least one stop 116 may have any suitable shape. Possible shapes include, but are not limited to, a rectangular plate, a trapezoidal plate, a rectangular prism, a curved plate, a hemispherical shape, a trapezoidal prism, a rectangle projection, a square projection, a spherical projection, and any other suitable geometrical shapes. In some embodiments, the shape of the at least one stop 116 corresponds to the shape of the utensil 110 to be dispensed. For example, in embodiments where a spoon 110 is to be dispensed, the at least one stop 116 may be generally spherical. If more than one stop 116 is used, the stops 116 may have different shapes and/or dimensions from one another (different lengths, different widths Y, and/or different depths Z, etc).

In the embodiment illustrated in FIGS. 1-12, the top of the stop 116 is separated from a lower edge 113 (as shown in FIGS. 6-7) of the opening 112 by a distance Q. In other embodiments, the distance Q from the top of the at least one stop 116 to the lower edge 113 of the opening 112 may be greater or smaller, depending on the desired fanning of the utensils 110. If it is desired that the utensils 110 fan through the opening 112 at a lesser angle or extent, the at least one stop 116 may be separated from the lower edge 113 of the opening 112 by a distance greater than Q. Conversely, if it is desired that the utensils 110 fan through the opening 112 at a greater angle or extent, the at least one stop 116 may be separated from the lower edge 113 of the opening 112 by a distance less than Q.

In some embodiments, as illustrated in FIGS. 5-7, the at least one stop 116 includes a contact side 150, which interacts with the utensils 110 housed in the trough 114. The configuration of the contact side 150 may also be varied to influence the angle and/or extent at which the utensils 110 fan through the opening 112. In some embodiments, as illustrated in FIGS. 5-7, the contact side 150 is uniform. In other embodiments, the contact side 150 may slope in a left-to-right and/or front-to-back direction or be otherwise non-uniform. In these embodiments, the least one stop 116 causes not only a portion of the utensil 110 to fan through the opening 112, but may also impart rotation to the utensil 110 so that the utensil 110 twists as it fans through the opening 112. In other embodiments, a twist is imparted by other means.

The distance of the at least one stop 116 from the handle end of the utensil 110 housed in the trough 114 may also vary to affect the fanning of the utensils 110 through the opening 112. In the embodiment illustrated in FIGS. 1-12, this distance is generally shown as P. If it is desired that the utensils 110 fan through the opening 112 at a lesser angle or extent, the at least one stop 116 may be separated from the bottom end of the utensil 110 housed in the trough 114 by a distance greater than P. Conversely, if it is desired that the utensils 110 fan through the opening 112 at a greater angle or extent, the at least one stop 116 may be separated from the bottom end of the utensil 110 housed in the trough 114 by a distance less than P.

Figure 13:
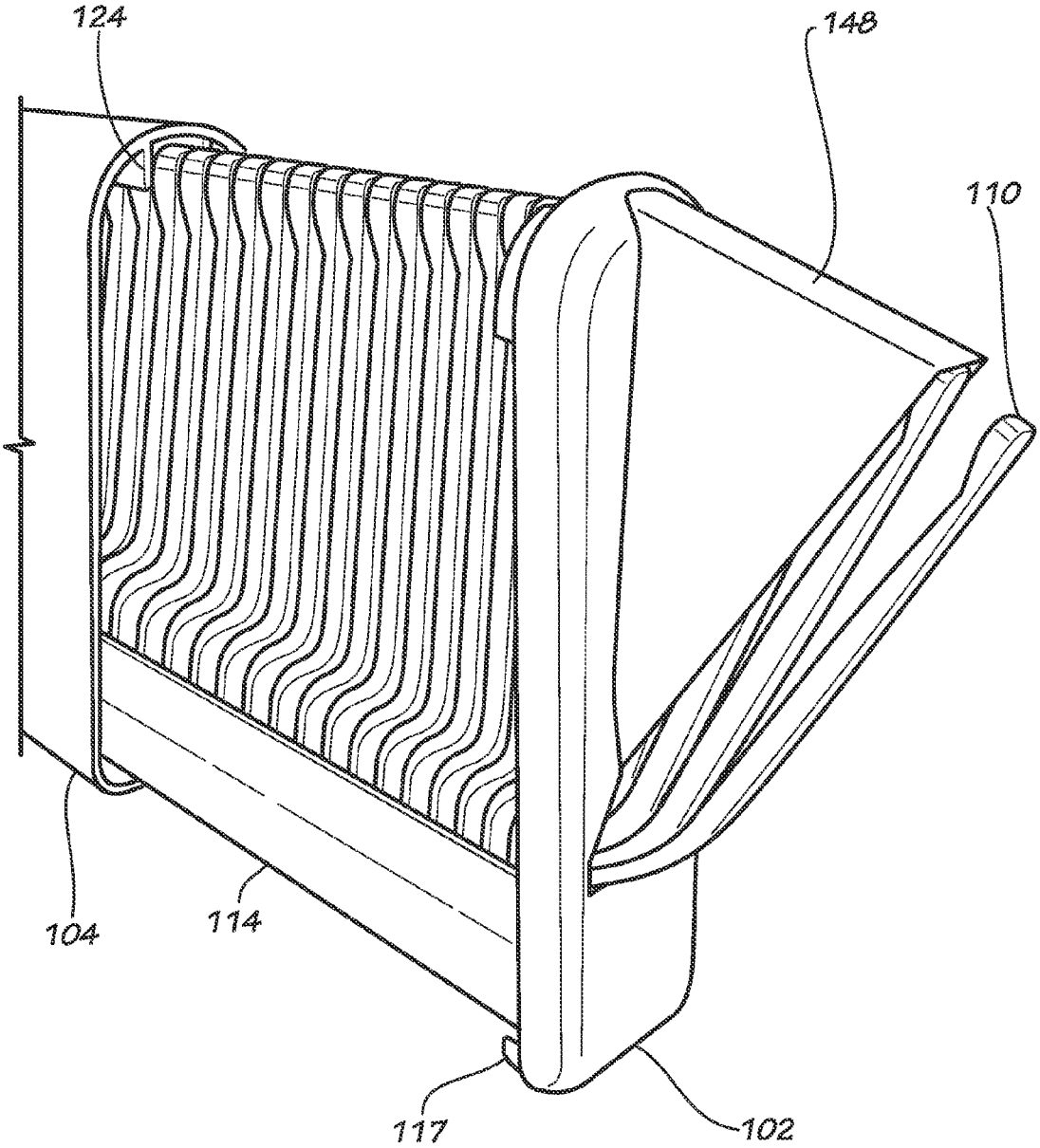
FIG. 13 is a front perspective view of an alternative embodiment of a cutlery dispenser.

In some embodiments, the shape of the opening 112 may also affect the angle and/or extent at which utensils 110 are fanned through the opening 112. In some embodiments, for example, the lower edge 113 of the opening 112 may be configured to limit the angle at which the utensils 110 fan through the opening 112. In these embodiments, the utensil 110 is fanned through the opening 112 by the at least one stop 116, but such fanning movement is limited by the utensil's 110 contact with the lower edge 113 of the opening 112. Similarly, in some embodiments, the opening 112 is shaped so as to limit the range of motion of the utensil 110 when it is withdrawn from the dispenser 100 by the user. The opening 112 may be configured so that the utensil 110 may be "peeled out" from the dispenser 100 (in other words, removal of the utensil 110 is only permitted at a specific angle or over a range of specific angles), or may be configured so that removal of the utensil 110 is permitted through the opening 112 at any desired angle. For example, in some embodiments, such as the embodiment illustrated in FIG. 13, the front cover 102 may further include an overhang 148 that surrounds or covers at least a portion of one of the fanned out utensil 110. The overhang 148 may be configured to protect the fanned utensils 110 from the outside environment. In some embodiments, as illustrated in FIG. 13, the overhang 148 may be configured to prevent access to utensils 110 stored behind the forward-most utensil 110.

As is apparent from the above discussion, the at least one stop 116 may have any suitable configuration so long as it causes the utensils 110 to fan and/or rotate and/or separate from one another upon contact with the at least one stop 116. The amount of fanning and/or rotation and/or separation may be influenced by many factors, including, but not limited to, the distance Q between the at least one stop 116 and the lower edge 113 of the opening 112, the distance P between the at least one stop 116 and the bottom end of the utensil 110 housed in the trough 114, the depth Z of the at least one stop 116, the shape of the opening 112, the shape of the at least one stop 116, and/or the orientation of the contact side 150 of the at least one stop 116.

The at least one stop 116 may be formed of a number of materials, including, but not limited to, polypropylene, other plastics, aluminum, or any other suitable material. In some embodiments, the at least one stop 116 is integrally formed with the front cover 102. In other embodiments, the at least one stop 116 is coupled by any suitable mechanism to the front cover 102, or both.

As mentioned above, the front cover 102 may be coupled by any suitable mechanism to the housing 104. In some embodiments, the front cover 102 may be slidably attached to the housing 104 so that the front cover 102 has an open position and a closed position with respect to the housing 104. In some embodiments, the front cover 102 may be removably coupled to the housing 104 so that the front cover 102 may be physically separated from the housing 104 when the two are not coupled. The coupling can be achieved by any number of standard coupling means, including, but not limited to, snap-fitting, pressure-buttons, sealing, hinge, and other similar mechanisms. For example, in the embodiment illustrated in FIGS. 1-12, the front cover 102 may be coupled to the housing 104 via a plurality of snap-fit members 117 (shown in FIGS. 2-3 and 5-7). In other embodiments, the front cover 102 may be coupled to the housing 104 via a hinge or other suitable fastener.

The housing 104 may be constructed of a number of materials, including, but not limited to, polypropylene, other plastics, aluminum, or any other suitable material. In some embodiments, the housing 104 resembles an elongated shell. The cross-sectional shape of the housing 104 may vary. In some embodiments, the shape and configuration of the housing 104 is such that the housing 104 is free-standing. In some embodiments, the housing 104 may include a base or feet. In these ways, the housing 104 can be placed on or secured to a countertop or other structure. In some embodiments, a length of the housing 104 may be slightly greater than that of a utensil 110 to be dispensed from the cutlery dispenser 100 and a width of the housing 104 is slightly greater than the width of the utensil 110 to be housed and dispensed from the cutlery dispenser 100. The cross-sectional shape of the housing 104 may also generally correspond to the shape of the front cover 102. Possible shapes include, but are not limited to, rectangles, triangles, squares, etc, and variants there of. In the embodiment illustrated in FIGS. 1-12, for example, the cross-sectional shape of the housing 104 is rectangular with curved corners.

Figure 10:
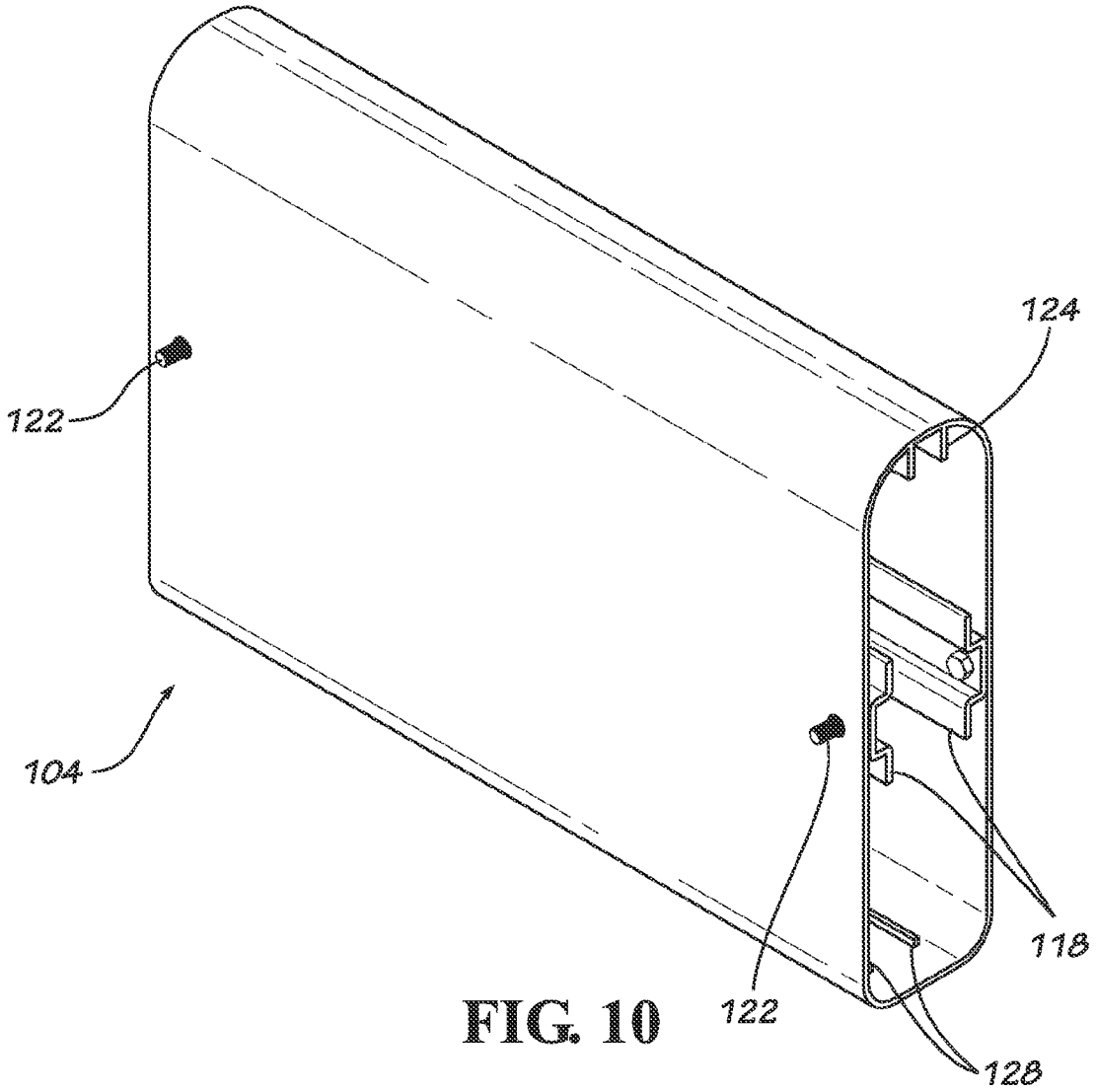
FIG. 10 is a side perspective view of the housing of the cutlery dispenser of FIG. 1.
Figure 11:
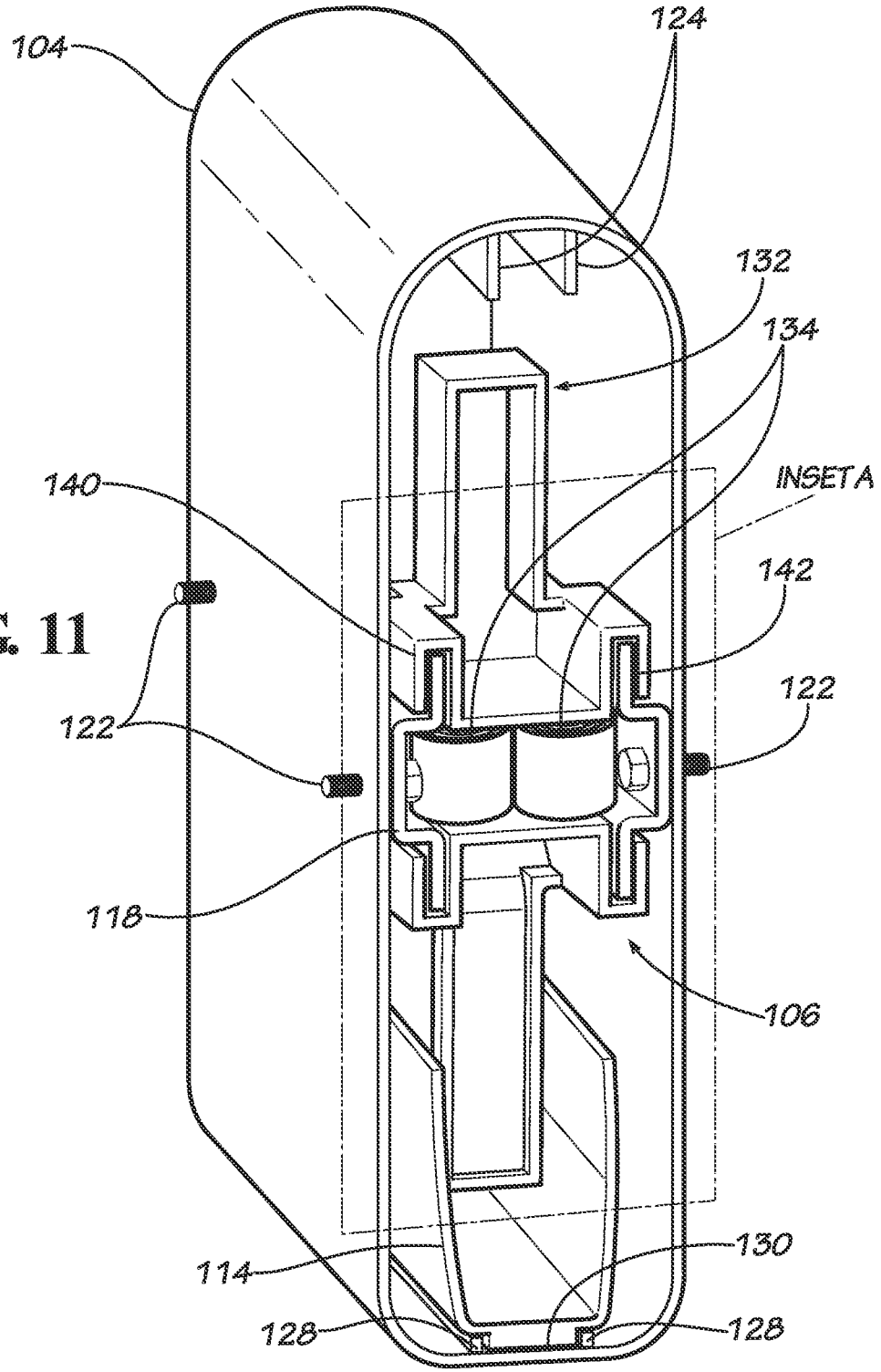
FIG. 11 is a rear perspective view of the cutlery dispenser of FIG. 1, with the end-cap removed.
Figure 12:
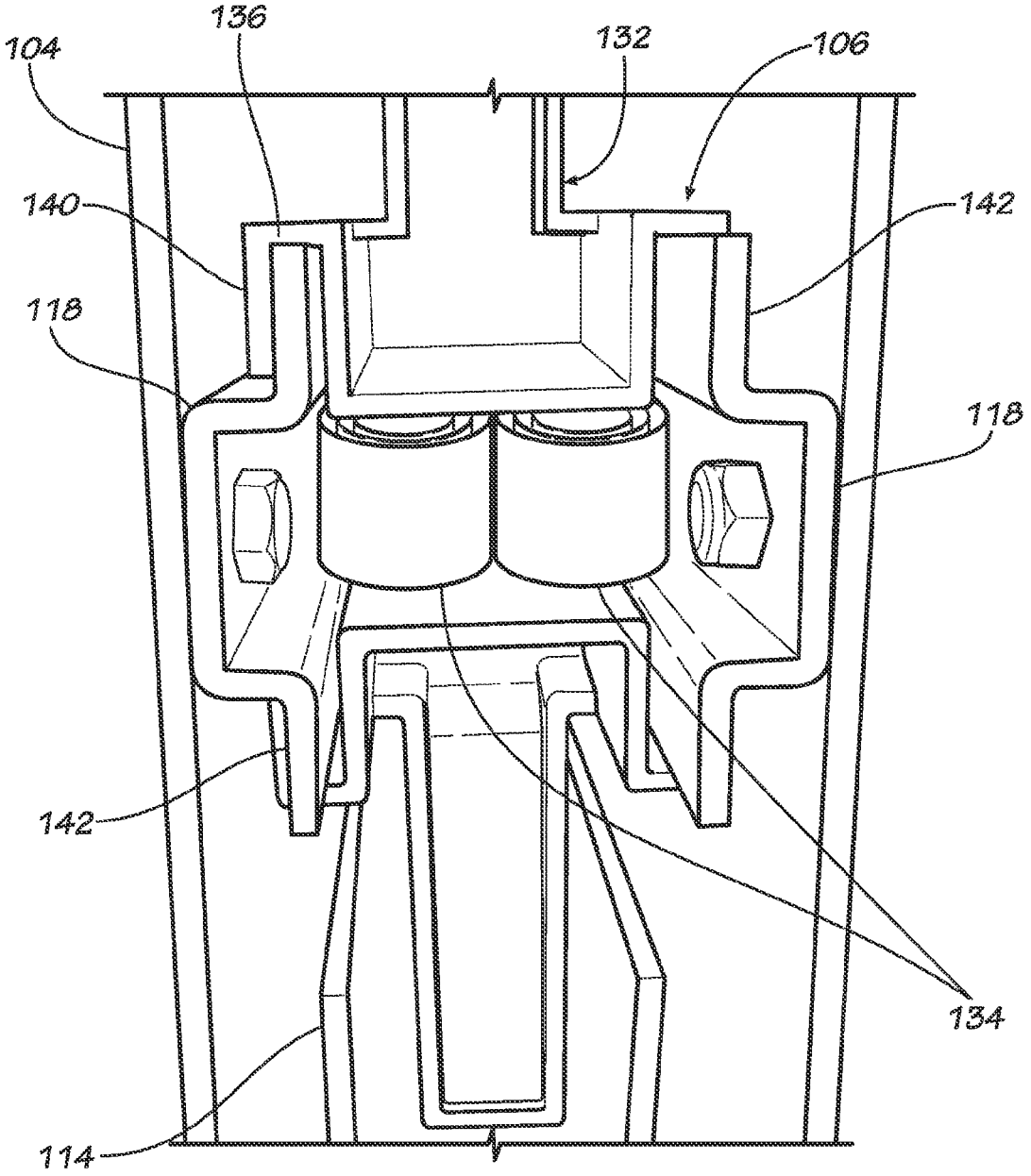
FIG. 12 is an enlarged view of a portion of the cutlery dispenser of FIG. 11, taken at inset A.

In one embodiment of the cutlery dispenser 100, as illustrated in FIGS. 11-12, the housing 104 surrounds the trough 114, any utensils 110 positioned within the housing 104 (not pictured), and the pushing assembly 106. In some embodiments, the housing 104 may include at least one track 118 (FIGS. 3 and 10-12) upon which the pushing assembly 106 travels. One having ordinary skill in the art, however, will recognize that there exist embodiments of the cutlery dispenser 100 in which no track 118 is included. In those embodiments, the pushing assembly 106 may travel along the trough 114 or housing 104.

Figure 9:
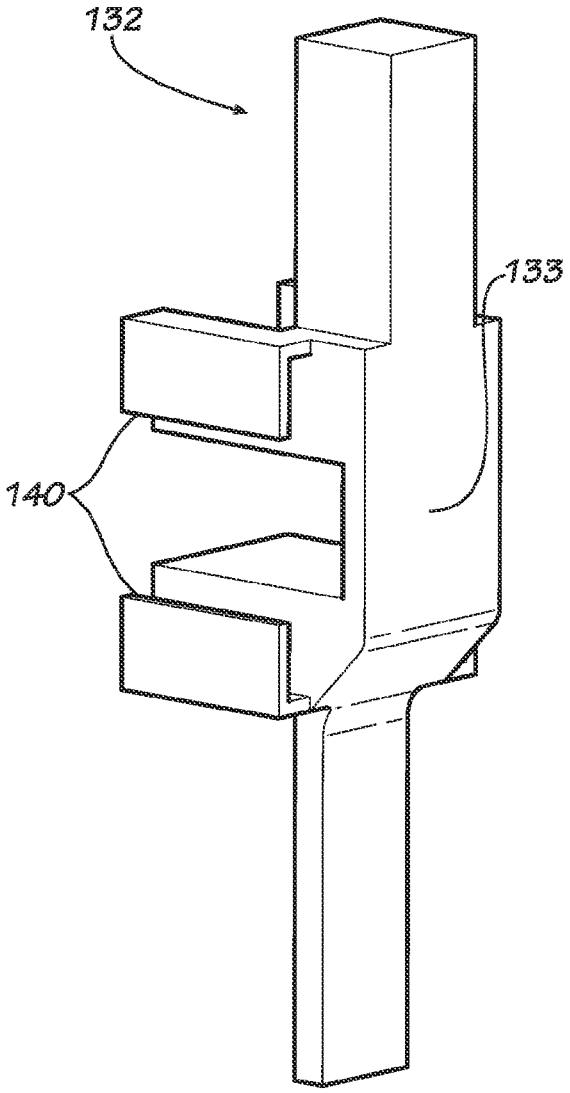
FIG. 9 is a front perspective view of the support member of FIG. 8.

The at least one track 118 may be configured to interact with the pushing assembly 106 so that the pushing assembly 106 is capable of traversing the depth of the housing 104. The at least one track 118 may be constructed of a number of materials, including, but not limited to, polypropylene, other plastics, aluminum, or any other suitable material. In some embodiments, the at least one track 118 may be integrally formed with the housing 104. In other embodiments, the at least one track 118 may be coupled to the housing 104. In those embodiments, such as the embodiment illustrated in FIGS. 1-12, the at least one track 118 may be coupled to the housing 104 in any suitable manner, including, but not limited to, using any suitable fastener. Multiple tracks 118 may also be used, as illustrated in FIGS. 10-12. For example, in the embodiment illustrated in FIGS. 1-12, a pair of tracks 118 is coupled to the housing 104 by a fastener including a plurality of bolts 122 or the like (see FIGS. 3 and 10-12).

Figure 3:
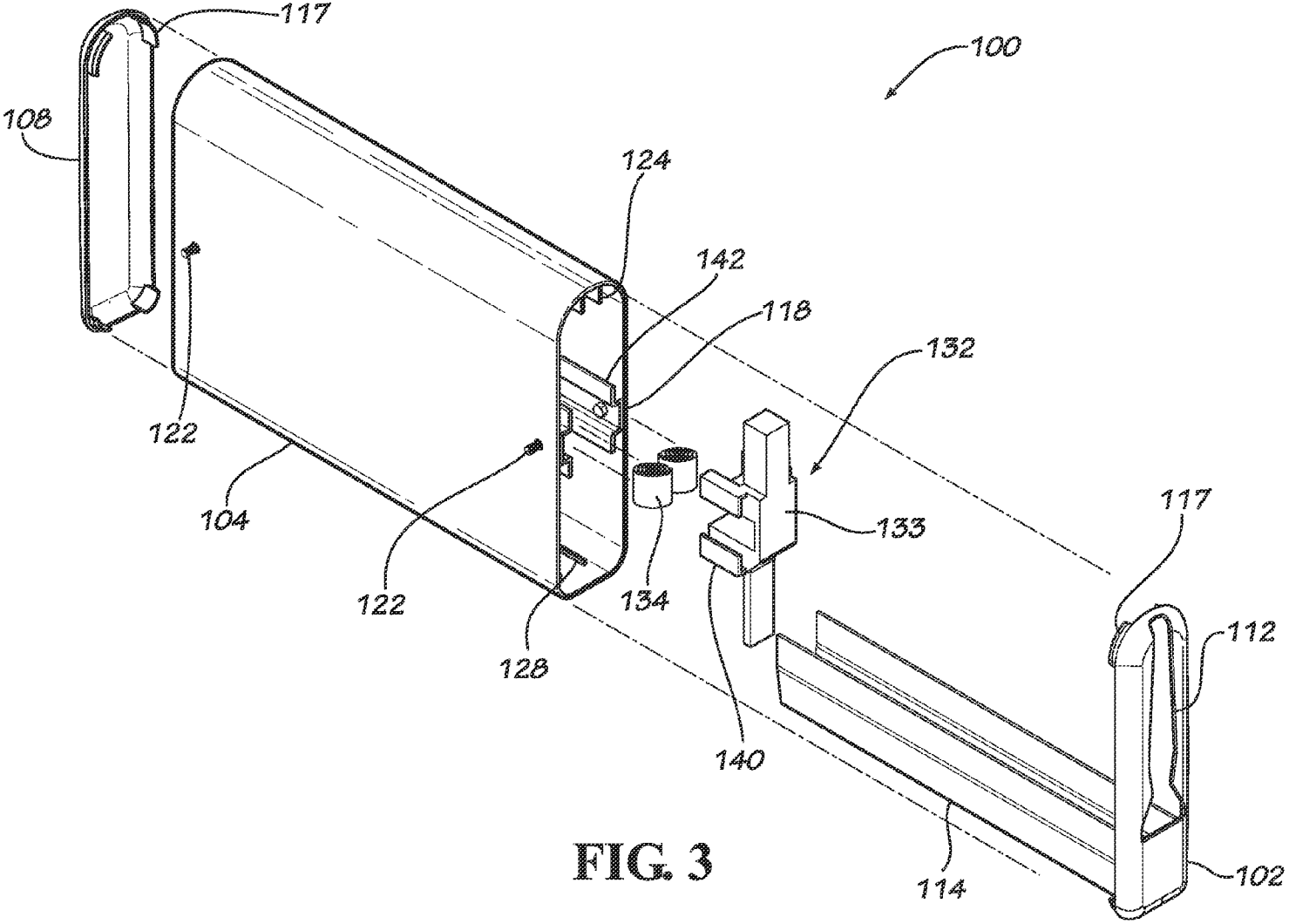
FIG. 3 is an exploded perspective view of the cutlery dispenser of FIG. 1.
Figure 4:
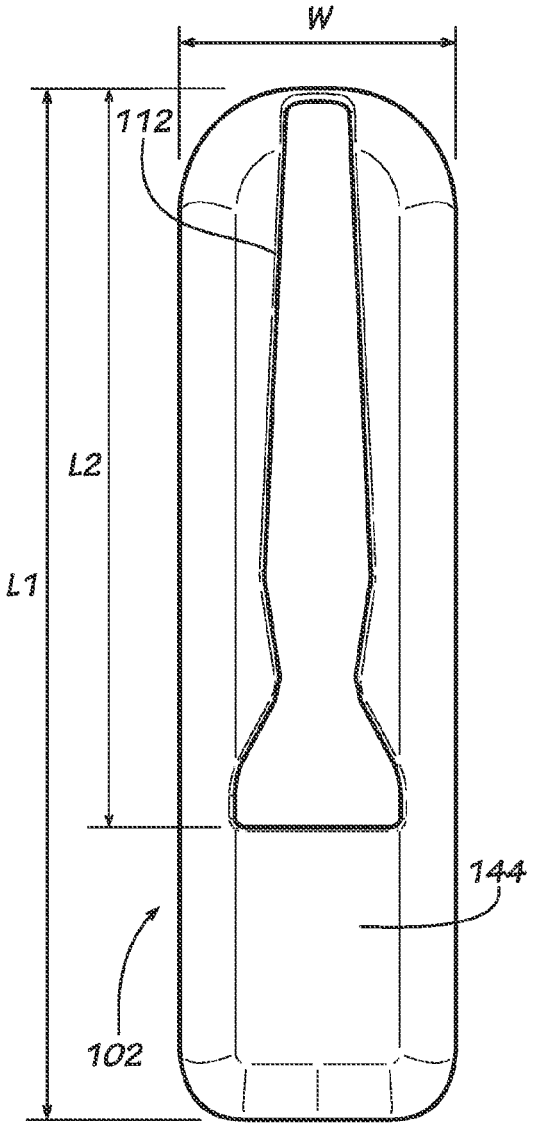
FIG. 4 is a front view of the front cover of the cutlery dispenser of FIG. 1.

In some embodiments, the housing 104 may include a utensil guide 124 (FIGS. 3 and 10-11). If used, the utensil guide 124 may help maintain the orientation of the utensils 110 within the trough 114 during dispensing and during insertion of the utensils 110 into the housing 104. The utensil guide 124 may be constructed of a number of materials, including, but not limited to, polypropylene, other plastics, aluminum, or any other suitable material. In some embodiments, such as the embodiment illustrated in FIGS. 1-12, the utensil guide 124 may be integrally formed with the housing 104. In other embodiments, the utensil guide 124 may be coupled to the housing 104. In some embodiments, such as the embodiment illustrated in FIGS. 1-12, the utensil guide 124 is formed of separate pieces, as illustrated in FIGS. 10 and 11. The position of the utensil guide 124 may vary within the housing 104. For example, in the embodiment illustrated in FIGS. 1-12, the utensil guide 124 is positioned toward the top of the housing 104, as illustrated in FIGS. 10 and 11. In that embodiment, the utensil guide 124 is composed of two prongs that extend downward from the inside surface of the top of housing 104. The prongs are separated a distance that corresponds to the width of the handle of the forks 110 or other utensils 110 contained within the trough 114. In other embodiments, the front cover 102 may include the utensil guide 124. In those embodiments, the utensil guide 124 extends from the rear surface 146 of the front cover 102. In some embodiments, the utensil guide 124 may be integrally formed with the front cover 102, while in other embodiments the utensil guide 124 may be coupled in any suitable manner to the front cover 102.

In some embodiments, such as the embodiment illustrated in FIGS. 1-12, the housing 104 further includes a trough guide 128 (FIGS. 3 and 10-11). The trough guide 128 helps align the trough 114 of the front cover 102 with the housing 104. The trough guide 128 may be constructed of a number of materials, including, but not limited to, polypropylene, other plastics, aluminum, or any other suitable material. In some embodiments, such as the embodiment illustrated in FIGS. 1-12, the trough guide 128 may be integrally formed with the housing 104. In other embodiments, the trough guide 128 may be coupled to the housing 104. In some embodiments, as illustrated in FIGS. 10 and 11, the trough guide 128 may be formed of separate pieces. The position of the trough guide 128 may vary within the housing 104. For example, in the embodiment illustrated in FIGS. 1-12, the trough guide 128 is positioned on the bottom surface of the housing 104, as illustrated in FIG. 11. In some embodiments, such as the embodiment illustrated in FIGS. 1-12, the trough 114 may include at least one protrusion 130 that is received within the trough guide 128, as illustrated in FIGS. 6 and 11, to guide the positioning of the trough 114 within the housing 104.

In some embodiments, the housing 104 may further include a window or opening, which allows a user to view inside the housing 104 and/or any utensils 110 inside the housing 104. The window or opening may be positioned as desired along the housing 104.

In some embodiments, the housing 104, rather than the front cover 102, may include the at least one stop 116.

The pushing assembly 106 includes a support member 132 and at least one biasing mechanism 134 (FIGS. 11-12). The pushing assembly 106 may be positioned within the housing 104, for example, by aligning the support member 132 with the at least one track 118, trough 114, or housing 104. In some embodiments, only a portion of the pushing assembly 106 is coupled to the housing 104. For example, a variety of structures may be used to couple the pushing assembly 106 to the housing 104, including, but not limited to, any suitable fastener.

One surface, such as contact surface 133 (FIGS. 3 and 8-9) of support member 132 contacts the utensils 110 housed in the housing 104, while the at least one biasing mechanism 134 urges the support member 132 toward a front 138 of the at least one track 118, as explained below. The support member 132 may be slidably engaged with the at least one track 118. As the support member 132 slides along the at least one track 118 toward the front cover 102 via the biasing mechanism 134, the support member 132 applies force to the plurality of utensils 110 contained in the housing 104 so as to advance the utensils 110 toward the opening 112 when a utensil 110 is removed by a user from the cutlery dispenser 100 through the opening 112. In some embodiments, such as the embodiment illustrated in FIGS. 1-12, the support member 132 may maintain the housed utensils 110 in the trough 114 in a orientation generally perpendicular to the longitudinal axis of the trough 114 until the utensils 110 reach the at least one stop 116. The support member 132 may be constructed of a number of materials, including, but not limited to, polypropylene, other plastics, aluminum, or any other suitable material. The shape of the support member 132 may vary. In some embodiments, the support member 132 is generally rectangular. In some embodiments, such as the embodiment illustrated in FIGS. 1-12, the shape of the support member 132, which may include a non-uniform depth, may correspond to the shape of the utensil 110 to be dispensed. Such a shape helps maintain the utensil 110 in orientation generally perpendicular to the longitudinal axis of the trough 114 until the utensil 110 reaches the at least one stop 116. For example, contact surface 133 of the support member 132 may correspond to a side of the utensil 110 that the support member 132 contacts, as illustrated in FIG. 9. In these embodiments, the overall shape of the support member 132 may vary depending on a number of factors, including, but not limited to, the length of the at least one track 118, the thickness of the utensil 110 to be dispensed, and/or the position of the at least one stop 116. In some embodiments, and as illustrated in FIGS. 3 and 9, the overall shape of support member 132 may be such to allow the support member 132 to contact the rear of a single utensil 110 while that utensil 110 also contacts the at least one stop 116 and fans through the opening 112. The shape of the support member 132 may also be varied to influence the angle and extent at which the utensils 110 fan through the opening 112.

The at least one biasing mechanism 134 may be composed of one or more springs, one or more rubber bands, one or more magnets, or anything that would help urge the support member 132 to its position when the biasing mechanism 134 is not stressed. For example, in the embodiment illustrated in FIGS. 1-12, two coil springs serve as the biasing mechanism 134, as illustrated in FIGS. 11-12. In this embodiment, one end of each of the two biasing mechanisms 134 attaches to the two tracks 118, while the remainder of each of the biasing mechanisms 134 wraps around a post of the support member 132. In other embodiments, the biasing mechanism 134 may be attached to the front cover 102 or the housing 104 or housed in the trough 114. In some embodiments, such as the embodiment illustrated in FIGS. 1-12, an end of the biasing mechanism 134 may include an aperture (not illustrated), through which any suitable fastener, including but not limited to a screw, rivet, or plastic boss, may pass to attach the biasing mechanism 134 to the at least one track 118. In other embodiments, the biasing mechanism 134 may be attached directly to the housing 104. The biasing mechanisms 134 may also be attached to the support member 132 in any other suitable manner, including but not limited to a welding means. Because one end of each biasing mechanism 134 is in a fixed position relative to the at least one track 118, movement of the support member 132 toward a rear 136 of the at least one track 118 lengthens or shortens the biasing mechanisms 134. When the biasing mechanisms 134 retract or expand, the biasing mechanisms 134 urge the support member 132 toward the front 138 of the at least one track 118. The one or more biasing mechanisms 134 may be constant or variable force springs, such as those sold under the trademark Conforce®, or any other suitable type or brand of spring.

The pushing assembly 106 may be slidably engaged with the at least one track 118 in a variety of manners. For example, in the embodiment illustrated in FIGS. 1-12, the support member 132 includes a plurality of arms 140 (FIGS. 8-9 and 11-12), which are slidably engaged with a plurality of legs 142 (FIGS. 11-12) of the tracks 118. In some embodiments, barriers or other structures may be placed along the legs 142 to restrict the range of travel of the support member 132.

In some embodiments, the cutlery dispenser 100 may include an end-cap 108, which is coupled to the rear of the housing 104 and is illustrated in FIGS. 1 and 3. The end-cap 108 prevents exposure of the utensils 110 to outside conditions and possible contamination. The end-cap 108 may be coupled to the housing 104 in a variety of ways, including, but not limited to, snap-fitting, pressure-buttons, sealing, and other similar means. For example, in the embodiment illustrated in FIGS. 1-12, the end-cap 108 is coupled to the housing 104 via a plurality of snap-fit members 117.

Fully assembled, one non-limiting method of operating the embodiment illustrated in FIGS. 1-12 is as follows. The front cover 102 is slid away or removed from the housing 104 along the trough guide 128, moving the cutlery dispenser 100 from its closed position to its open position (FIG. 2) to expose the trough 114. A plurality of utensils 110 is inserted into the trough 114. In the embodiment illustrated in FIGS. 1-12, the plurality of utensils 110 includes forks 110. In other embodiments, however, the plurality of utensils 110 includes spoons, knives, sporks, or any combination thereof. The plurality of utensils 110 may be inserted into the trough 114 in a number of ways. For example, the utensils 110 may be inserted one-by-one. Alternatively, a cartridge of utensils 110, which are bound together by a restrictive means such as a paper band, a rubber band, etc., may be inserted in the trough 114, whereby the restrictive means of either end of the cartridge is removed after insertion to allow the support member 132 of the pushing assembly 106 to contact the rear of the rear-most utensil 110 and allow a portion of the forward-most utensil 110 to contact the at least one stop 116 such that a portion of the forward-most utensil 110 fans through the opening 112.

After insertion of the utensils 110, the front cover 102 is slid back toward or coupled to the housing 104 so that the cutlery dispenser 100 is moved from its open position to its closed position (FIG. 1). In some embodiments, such as the embodiment illustrated in FIGS. 1-12, the movement of the cutlery dispenser 100 between its open and closed position is aided by the trough guide 128 and protrusions 130. In some embodiments, the utensil guide 124 aids the transition between the open and closed positions. When the cutlery dispenser 100 moves from its open to its closed position, the rear-most utensil 110 in the trough 114 contacts the support member 132 of the pushing assembly 106. The movement of the cutlery dispenser 100 from the open to the closed position urges the support member 132 toward the rear 136 of the at least one track 118 via the utensils 110. In one embodiment, the force applied by the support member 132 to the utensils 110 conversely urges a portion of the forward-most utensil 110 forward until it rests against the at least one stop 116. Given that the at least one stop 116 only contacts a portion of the forward-most utensil 110, another portion of the utensil 110 fans through the opening 112.

The cutlery dispenser 100 is then ready for use by a user. As illustrated in FIG. 1, a portion of the forward-most utensil 110 (in this case, the handle of a fork 110) is fanned through the opening 112. A user may grasp the handle and withdraw the utensil 110 from the cutlery dispenser 100 without contaminating at least the utility end of any other utensil 110 in the cutlery dispenser 100. Upon withdrawal of a utensil 110, the pushing assembly 106 moves the remaining utensils 110 forward, such that a portion of another utensil 110 will contact the at least one stop 116 and a portion of another utensil 110 will fan through the opening 112. This process will continue until all utensils 110 are removed from the cutlery dispenser 100.

In some embodiments, the width of the cutlery dispenser 100 need only be slightly greater than the corresponding width of the utensil 110. Similarly, the length of the cutlery dispenser 100 need only be slightly greater than the corresponding length of the utensil 110. Additionally, multiple cutlery dispensers 100 may be used in connection with one another to house multiple types of utensils 110. For example, multiple cutlery dispensers 100 may be positioned adjacent one another or stacked on top of on another. These cutlery dispensers 100 may be free-standing or coupled to one another by any variety of coupling means or housed together within a housing structure. Thus, the cutlery dispenser 100 is an effective means of reliably dispensing sanitary utensils 110, without monopolizing a great deal of space.

The foregoing is provided for purposes of illustrating, explaining, and describing embodiments of the present invention. Further modifications and adaptations to these embodiments will be apparent to those skilled in the art. The features and aspects of the present invention have been described or depicted by way of example only and are therefore not intended to be interpreted as required or essential elements of the invention unless otherwise so stated. It should be understood, therefore, that the foregoing relates only to certain exemplary embodiments of the invention, and that numerous changes and additions may be made thereto without departing from the spirit and scope of the invention as defined by any appended claims.

The invention claimed is:

1. A cutlery dispenser, comprising:

(a) a housing comprising a pushing assembly comprising at least one biasing mechanism and a support member coupled to the at least one biasing mechanism, wherein the at least one biasing mechanism urges the support member toward a front of the dispenser; and (b) a front cover coupled to the housing, the front cover comprising:

(i) a front surface comprising an opening;

(ii) a rear surface comprising the opening;

(iii) a trough;

(iv) a first protruding member extending a distance Z1 from the rear surface; and (v) a second protruding member extending a distance Z2 from the rear surface or a base of the trough;

wherein distance Z1 and distance Z2 are different distances such that the first protruding member and second protruding member are configured to interact with a portion of a plurality of utensils housed within the trough to cause the plurality of utensils to pivotably rotate through the opening when a force is applied to the plurality of utensils by the support member such that a number of the plurality of utensils fan through the opening with at least one end in a spaced apart relationship.

2. The cutlery dispenser of claim 1, wherein the second protruding member extends from the rear surface of the front cover.

3. The cutlery dispenser of claim 1, wherein the second protruding member extends from the trough.

4. The cutlery dispenser of claim 1, wherein the front cover is slidably coupled to the housing.

5. The cutlery dispenser of claim 1, wherein the front cover is removably coupled to the housing.

6. The cutlery dispenser of claim 1, wherein at least one of the trough, the first protruding member and the second protruding member is integrally formed with the front cover.

7. The cutlery dispenser of claim 1, wherein the trough is capable of housing a plurality of utensils.

8. The cutlery dispenser of claim 7, wherein the trough is configured to house a fork, a spoon, a knife, a spork, or any combination thereof.

9. The cutlery dispenser of claim 1, wherein the shape of the opening at least partially corresponds to a shape of at least a portion of a utensil.

10. The cutlery dispenser of claim 1, wherein the biasing mechanism is comprised of at least one of a spring or a rubber band.

11. The cutlery dispenser of claim 1, wherein the support member comprises a contact surface that at least partially corresponds in shape to a shape of at least a portion of a utensil.

12. The cutlery dispenser of claim 1, wherein the housing further comprises a utensil guide for maintaining an orientation of a utensil.

13. The cutlery dispenser of claim 1, wherein the housing further comprises a trough guide for aligning the trough with the housing.

14. The cutlery dispenser of claim 13, wherein the trough comprises at least one protrusion for interaction with the trough guide.

15. A cutlery dispenser, comprising:

(a) a housing comprising:

(i) at least one track; and (ii) a pushing assembly comprising at least one biasing mechanism and a support member coupled to the at least one biasing mechanism and slidably engaged with the at least one track, wherein the at least one biasing mechanism urges the support member toward a front of the dispenser; and (b) a front cover coupled to the housing, the front cover comprising:

(i) a front surface comprising an opening;

(ii) a rear surface comprising the opening; and (iii) a first protruding member extending a distance Z1 from the rear surface; and (c) a second protruding member extending a distance Z2 from the rear surface or the housing;

wherein distance Z1 and distance Z2 are different distances such that the first protruding member and second protruding member are configured to interact with a portion of a plurality of utensils housed within the housing to cause the plurality of utensils to pivotably rotate through the opening when a force is applied to the plurality of utensils by the support member such that a number of the plurality of utensils fan through the opening with at least one end in a spaced apart relationship.

16. The cutlery dispenser of claim 15, wherein the second protruding member extends from the rear surface of the front cover.

17. The cutlery dispenser of claim 15, wherein the second protruding member extends from the housing.

18. The cutlery dispenser of claim 15, wherein the front cover is slidably coupled to the housing.

19. The cutlery dispenser of claim 15, wherein the support member comprises a contact surface that at least partially corresponds in shape to a shape of a utensil.

20. The cutlery dispenser of claim 15, wherein the housing further comprises a utensil guide for maintaining an orientation of a utensil.

21. A cutlery dispenser comprising:

(a) a housing comprising:

(i) at least one track; and (ii) a pushing assembly comprising at least one biasing mechanism and a support member coupled to the at least one biasing mechanism and slidably engaged with the at least one track, wherein the at least one biasing mechanism urges the support member toward a front of the dispenser; and (b) a front cover coupled to the housing, the front cover comprising:

(i) a front surface comprising an opening;

(ii) a rear surface comprising the opening;

(iii) a trough;

(iv) a first protruding member extending a distance Z1 from the rear surface; and (v) a second protruding member extending a distance Z2 from the rear surface or a base of the trough;

distance Z1 and distance Z2 are different distances such that the first protruding member and second protruding member are configured to interact with a portion of a plurality of utensils housed within the trough to cause the plurality of utensils to pivotably rotate through the opening when a force is applied to the plurality of utensils by the support member such that a number of the plurality of utensils fan through the opening with at least one end in a spaced apart relationship.

22. The cutlery dispenser of claim 21, wherein the second protruding member extends from the rear surface of the front cover.

23. The cutlery dispenser of claim 21, wherein at least one of the second protruding member extends from the trough.

24. The cutlery dispenser of claim 21, wherein at least one of the trough, the first protruding member and the second protruding member is integrally formed with the front cover.

25. The cutlery dispenser of claim 21, wherein the at least one track comprises at least one leg that interacts with at least one arm of the support member.

26. The cutlery dispenser of claim 21, wherein the housing further comprises a utensil guide for maintaining an orientation of a utensil.

27. The cutlery dispenser of claim 21, wherein the housing further comprises a trough guide for aligning the trough with the housing.

28. The cutlery dispenser of claim 27, wherein the trough comprises at least one protrusion for interacting with the trough guide.

29. The cutlery dispenser of claim 1, wherein the rotation of the utensil plurality of utensils through the opening causes the plurality of utensils to separate from each other.

30. The cutlery dispenser of claim 15, wherein the rotation of the plurality of utensils through the opening causes the plurality of utensils to separate from each other.

31. The cutlery dispenser of claim 21, wherein the rotation of the plurality of utensils through the opening causes the plurality of utensils to separate from an each other.

* * * * *